US005927285A

United States Patent [19]

Lozano et al.

[11] Patent Number: 5,927,285

[45] Date of Patent: Jul. 27, 1999

[54] COMPACT ASHTRAY

[76] Inventors: Adrianna Lozano, 6044 S. 75th Ave., Summit, Ill. 60501; Jose M. Diaz, 4240 W. 83rd St., Chicago, Ill. 60652

[21] Appl. No.: 08/944,952

[22] Filed: Oct. 7, 1997

[51] Int. Cl.[6] ..... A24D 1/12

[52] U.S. Cl. ..... 131/231; 131/270

[58] Field of Search ..... 131/231, 270, 131/175, 237, 235.1

[56] References Cited

U.S. PATENT DOCUMENTS

| | | | |
|---|---|---|---|
| 2,118,564 | 5/1938 | McCready | 206/41 |
| 2,487,131 | 12/1949 | Harris | 131/270 |
| 2,604,982 | 8/1952 | Cibie | 131/270 |
| 4,050,468 | 9/1977 | Wynnk | 131/232 |
| 4,353,379 | 10/1982 | Castellanos | 131/231 |
| 4,969,478 | 11/1990 | Keidar et al. | 131/231 |

*Primary Examiner*—John G. Weiss
*Assistant Examiner*—Charles W. Anderson
*Attorney, Agent, or Firm*—Patent & Trademark Services; Thomas Zack; Joseph H. McGlynn

[57] ABSTRACT

A compact ashtray assembly having a hollow closable housing with upper and a lower members. Insertable into the lower member is a removable tray member with a depending ash receiving well having its own closable top cover member. By rotating a handle on the well top cover it may be closed or opened. Appropriate locks and mounts for the tray permit it to be retained within the housing lower member. Additional features include a storage chamber pocket located in the housing's upper member for smoker articles such as cigarettes, lighters, matches, etc.

4 Claims, 1 Drawing Sheet

COMPACT ASHTRAY

BACKGROUND OF THE INVENTION

Ashtrays have been used for years by smokers to dispose of unwanted cigarette butts, cigar butts, matches, etc. When ashtrays are not readily available, such as outdoors, may smokers simply throw the discharged cigarettes or cigar at any convenient nearby location. This not only causes an environmental mess but can present a potential danger especially when the discharged object may still be partial lit. The present invention seeks to remedy this problem by providing for a compact ashtray that can be used to store smoking related items having a disposable removable ash tray portion with an internal closable opening all as further detailed in this specification.

DESCRIPTION OF THE PRIOR ART

Ashtrays are well known in the prior art. For example, the McCready invention (U.S. Pat. No. 2,118,564) discloses a smoker's accessory which can be used as an ashtray having telescoping interrelated cylindrical members having an opening to deposit refuse and a scraper.

The invention to Wynnyk (U.S. Pat. No. 4,050,468) describes a U-shaped flat pouch made of flexible material which can be opened by compressing its edges. In the Castellanos patent (U.S. Pat. No. 4,353,379) a tubular telescopingly member receives a side wall opening for an ash receiver while a helical tension spring acts to restrain the ash receiver when closed.

In U.S. Pat. No. 4,969,478 to Keidar et al. the pivotally mounted weighted portable ashtray has a top ash receptacle opening and a flat bottomed holder with an opening to support the ashtray in an upright position.

The present invention provides for a compact ashtray having an openable top, an internal removable tray with an ash receiving closable well and sufficient storage capacity for cigarettes and smoking related items such as a lighter or matches, etc. all as more further set forth in this specification.

SUMMARY OF THE INVENTION

This invention relates to a compact ashtray assembly having a closable top, an internal removable tray with a closable refuse well and sufficient internal capacity to store smoker related items such a cigarette lighter or matches.

It is the primary object of the present invention to provide for an improved portable ashtray assembly.

Another object is to provide for such an assembly having a removable tray portion with a closable depository for ashes.

These and other objects and advantages of the present invention will become apparent to readers from a consideration of the ensuing description and the accompanying drawings.

DESCRIPTION OF THE PREFERRED EMBODIMENT

Figure 1:
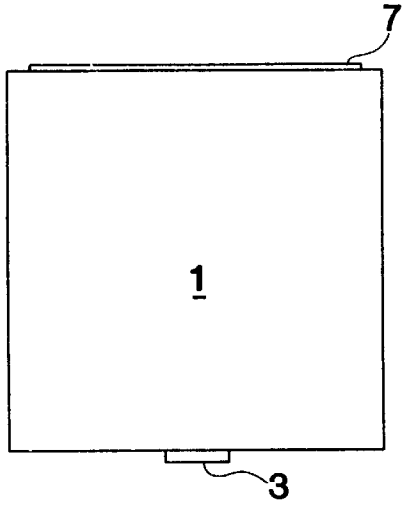
FIG. 1 is a top view of the invention's preferred embodiment with its top cover closed.

FIG. 1 is a top view of the invention's preferred embodiment with its top hinged housing cover 1 in a closed position. When in this position the compact ashtray assembly may be easily carried by a person in their pocket or purse. A small protruding closing clasp having two mating members, the upper shown top member 3 and a lower engageable member 5 (see FIG. 2), is also shown in this first figure. Located on the cover's opposite side from the clasp member 3 are the rear hinges 7 which pivotally mounted the top housing cover to its bottom housing member 9.

Figure 2:
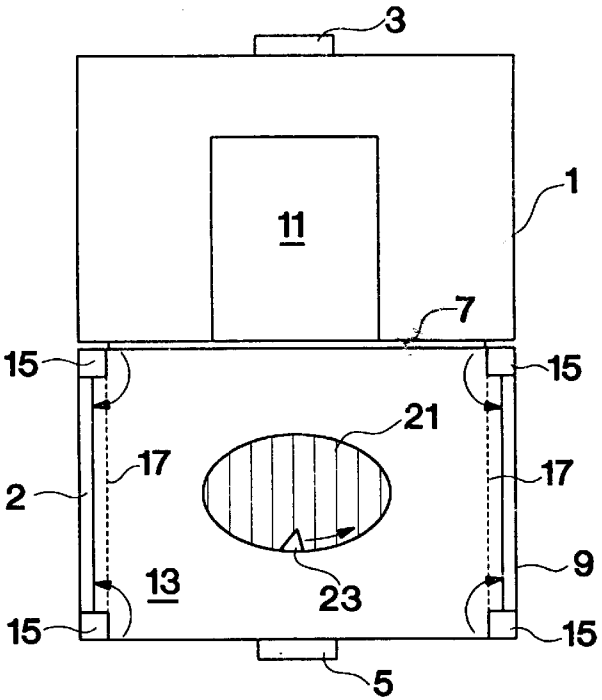
FIG. 2 is a top view of the FIG. 1 embodiment with its top cover opened to reveal its interior.

FIG. 2 is a top view of the FIG. 1 embodiment with its top housing cover opened to reveal its interior. The top 1 has sufficient depth to permit the storage of smoking related items in its pocket 11 such as a cigarette lighter, matches, a pack of cigarettes, several cigars, smoking tobacco, a pipe, etc. This pocket is opened on its top nearest the clasp member 3 to permit the insertion of such a smoking related item or items.

The bottom housing member 9 is closed on all sides except for its opened top. A removable mounted flat tray portion 13 with a center opening is inserted under the four corner pivotally mounted locking tabs 15 located on corner mounts on the top portion of the bottom 9 member. To remove the tray 13 when the housing top 1 is opened, the corner mounted tabs are pivotally moved to the side and the tray is lifted out on its lower bottom housing from the upper supporting side rails 17 on member 9. Also shown is the upper openable foldable cover 21 for the lower ash receiving well 19. This depending tray well and its cover 21 are mounted to the edges forming the center opening of removable tray 13. The well and tray are fixed to each other as their joining sides such that when the tray is removed the well and its ash content are also removed with it for proper disposal, cleaning, etc. A small protruding cover handle 23 is used to rotate the foldable cover to an opened or closed position to permit the inserting or disposal, as appropriate, of ashes into or from the well 19. Well 19 is closed on its cylindrical sides and circular bottom and made of a fireproof material as are all parts of the assembly, including openable cover 21, that may come into contact with any hot materials.

Figure 3:
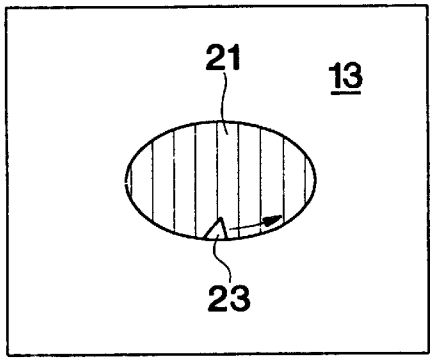
FIG. 3 shows a top view of the removable ashtray member.

FIG. 3 shows a top view of the removable tray 13 member by itself. The pleated foldable cover 21 can be opened by rotating the handle 23 in the direction of the arrow. By rotating the handle almost 360 degrees, the pleats in the cover fold on each other in accordion fashion to form a straight folded cover member extending from the opening center to the circumference of the circular well opening shown. When in this folded opened position the well is capable of receiving ashes for storage and later disposal. To close the opened covering, the handle 23 is simply rotated in the opposite direction until it is at the closed position shown in FIG. 3.

Figure 4:
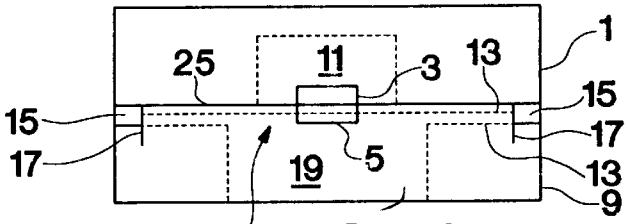
FIG. 4 shows a side view of the closed FIG. 1 embodiment.

FIG. 4 shows a side view of the closed FIG. 1 embodiment. In this figure the internal depending well 19 fixed to the flat removal upper tray 13 as well as the pocket 11 are depicted by dotted lines. The joining side edge 25 between the top and bottom housing members is shown to be just slightly higher than the top of supported upper tray 13 with its depending closable well 19.

The engaging mating clasp members 3 and 5 (see FIG. 2) are shown in a snap fit fastened position to keep the housing members 1 and 9 in a closed locked position. Other internal housing features shown in dotted line format are the front two lockable tray tabs 15 and their lower supporting rail members 17 which support and engage the tray 13. These rails may either extend substantially the total side depth of the bottom 9 on opposite sides, as shown in FIG. 2, or may be located only at the four bottom housing corners below the locking tabs and tray corners.

Clearly, the invention is not limited to the specific square or rectangular shapes shown for the housing members or the circular shape shown for the depending well 19 with its circular openable cover 21. Also any suitable material, such as any metallic material for all of the components or just for the ash receiving well, may be used. Both the well and is joining flat tray portion could be constructed in as a unitary structure or assembled from two different components.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What we claim as our invention is:

1. A compact ashtray assembly comprising:

a hollow housing having an upper member and a lower member closable with respect to each other, said upper member and lower member being pivotally joined together at one edge and having fastener members on the opposite edge from where pivotally joined together;

a tray member insertable into the lower housing member and completely removable from the housing, said removable tray having a top opening and a depending ash receiving well and a closable top member with a handle, said handle being movable with respect to the tray to position the top member to completely cover the tray's top opening; and a storage chamber within the upper member of the hollow housing for smoker articles.

2. The apparatus as claimed in claim 1, wherein said storage chamber within the hollow housing consists of a pocket suitable to store a fire source.

3. The apparatus as claimed in claim 1, wherein said removable tray member is held to the housing's lower member by lockable upper tabs and lower rail members.

4. The apparatus as claimed in claim 3, wherein said tray's closable top member can be opened and closed by rotating the handle.

* * * * *